US008533916B2

(12) United States Patent
Ahn

(10) Patent No.: US 8,533,916 B2
(45) Date of Patent: Sep. 17, 2013

(54) SWIVEL HINGE APPARATUS FOR AN ELECTRONIC DEVICE

(75) Inventor: Sung-Ho Ahn, Seoul (KR)

(73) Assignee: Samsung Electronics Co., Ltd., Yeongtong-gu, Suwon-si, Gyeonggi-do (KR)

( * ) Notice: Subject to any disclaimer, the term of this patent is extended or adjusted under 35 U.S.C. 154(b) by 0 days.

(21) Appl. No.: 13/281,527

(22) Filed: Oct. 26, 2011

(65) Prior Publication Data

US 2012/0140388 A1 Jun. 7, 2012

(30) Foreign Application Priority Data

Dec. 1, 2010 (KR) ..... 10-2010-0121144

(51) Int. Cl.
*E05D 15/30* (2006.01)
*E05D 3/12* (2006.01)
*E05D 3/10* (2006.01)

(52) U.S. Cl.
USPC ..... 16/362; 16/366; 16/367

(58) Field of Classification Search
USPC ..... 16/362, 366, 367, 334, 331, 332, 16/337, 338, 340, 371, 374; 455/575.1, 90.3, 455/575.3; 361/679.04, 679.06, 679.07, 361/679.1, 679.18–679.2, 679.27, 679.28; 379/433.11, 433.13; 403/84, 85, 86, 92, 403/93, 112, 116, 117, 161, 162, 163
See application file for complete search history.

(56) References Cited

U.S. PATENT DOCUMENTS 2,630,114 A * 3/1953 Hart ..... 600/193
2,682,705 A * 7/1954 Johnson ..... 30/324
2,742,936 A * 4/1956 Cooley ..... 30/519
3,259,006 A * 7/1966 Dukatz et al. ..... 411/524
3,986,272 A * 10/1976 Feierabent ..... 34/97
4,198,556 A * 4/1980 Crowley et al. ..... 392/384
4,485,544 A * 12/1984 Van Ryswyk ..... 29/417
4,603,246 A * 7/1986 Costa ..... 392/385
4,731,903 A * 3/1988 Kennedy et al. ..... 16/224
4,759,240 A * 7/1988 Lin ..... 81/177.8
4,824,278 A * 4/1989 Chang ..... 403/93
4,928,792 A * 5/1990 Krause ..... 182/163
5,022,118 A * 6/1991 Wan-Li ..... 16/327
5,026,198 A * 6/1991 Lin ..... 403/27
5,621,994 A * 4/1997 Cobb et al. ..... 40/782

(Continued)

FOREIGN PATENT DOCUMENTS

KR 2008-0107875 12/2008
KR 2008-0107876 12/2008
KR 10-0933595 12/2009

*Primary Examiner* — Victor Batson
*Assistant Examiner* — Jason W San
(74) *Attorney, Agent, or Firm* — Cha & Reiter, LLC

(57) ABSTRACT

A swivel hinge apparatus for an electronic device includes first and second hinge members, a guide portion, an elastic member, a shaft and a support cover portion. The first hinge member is bent. The second hinge member is inclined and coupled with the first hinge member to rotate while facing the first hinge member. The guide portion is positioned between the first hinge member and the second hinge member to guide rotation of the second hinge member. The elastic member is positioned on a side of the first hinge member to provide an elastic force for allowing rotation and linear movement of the first hinge member and the second hinge member. The shaft has a cylindrical housing protrudes therefrom, with the cylindrical housing being coupled with the first hinge member, the second hinge member, the elastic member, and the support cover portion by passing through them.

9 Claims, 16 Drawing Sheets

(56) References Cited

U.S. PATENT DOCUMENTS

| | | | | |
|---|---|---|---|---|
| 5,681,045 | A * | 10/1997 | Liao | 273/400 |
| 5,699,810 | A * | 12/1997 | Pallikaris | 128/898 |
| 5,815,875 | A * | 10/1998 | Yamada | 15/167.1 |
| 5,961,220 | A * | 10/1999 | Som et al. | 384/416 |
| 6,125,507 | A * | 10/2000 | Katoh | 16/329 |
| 6,385,808 | B1 * | 5/2002 | Yamada et al. | 15/167.1 |
| 6,421,878 | B1 * | 7/2002 | Kaneko et al. | 16/330 |
| 6,715,525 | B2 * | 4/2004 | Ehrenberger et al. | 160/23.1 |
| 6,785,936 | B2 * | 9/2004 | Koshikawa | 16/328 |
| 6,813,813 | B2 * | 11/2004 | Lu et al. | 16/342 |
| 6,845,546 | B1 * | 1/2005 | Lu et al. | 16/367 |
| 6,941,618 | B2 * | 9/2005 | Kim | 16/337 |
| 7,046,799 | B2 * | 5/2006 | Ma | 379/433.13 |
| 7,055,218 | B2 * | 6/2006 | Lu et al. | 16/367 |
| 7,118,079 | B2 * | 10/2006 | Kung | 248/125.8 |
| 7,133,280 | B2 * | 11/2006 | Love | 361/679.07 |
| 7,140,072 | B2 * | 11/2006 | Leng | 16/326 |
| 7,146,195 | B2 * | 12/2006 | Sudo et al. | 455/575.1 |
| 7,168,136 | B2 * | 1/2007 | Gan | 16/367 |
| 7,171,726 | B2 * | 2/2007 | Kleissen et al. | 16/235 |
| 7,334,296 | B2 * | 2/2008 | Park | 16/330 |
| 7,440,783 | B2 * | 10/2008 | Hyun | 455/575.3 |
| 7,444,715 | B2 * | 11/2008 | Tu et al. | 16/284 |
| 7,513,013 | B2 * | 4/2009 | Hsieh | 16/367 |
| 7,552,512 | B2 * | 6/2009 | Duan et al. | 16/330 |
| 7,591,047 | B2 * | 9/2009 | Chang et al. | 16/367 |
| 7,597,250 | B2 * | 10/2009 | Finn | 235/380 |
| 7,624,477 | B2 * | 12/2009 | Chien et al. | 16/286 |
| 7,665,184 | B2 * | 2/2010 | Duan et al. | 16/330 |
| 7,681,283 | B2 * | 3/2010 | Koshikawa et al. | 16/303 |
| 7,735,197 | B2 * | 6/2010 | Chien | 16/337 |
| 7,757,350 | B2 * | 7/2010 | Chiang et al. | 16/367 |
| 7,779,887 | B2 * | 8/2010 | Hammond et al. | 160/323.1 |
| 7,792,555 | B2 * | 9/2010 | Kawasaki et al. | 455/575.3 |
| 7,814,621 | B1 * | 10/2010 | Radke | 16/335 |
| 7,823,254 | B2 * | 11/2010 | Lin | 16/337 |
| 7,870,644 | B2 * | 1/2011 | Chang | 16/337 |
| 7,913,358 | B2 * | 3/2011 | Guo et al. | 16/330 |
| 7,954,203 | B2 * | 6/2011 | Chen et al. | 16/367 |
| 8,006,948 | B2 * | 8/2011 | Wents | 248/220.1 |
| 8,015,668 | B2 * | 9/2011 | Wang | 16/338 |
| 8,020,816 | B2 * | 9/2011 | Laitila et al. | 248/125.7 |
| 8,051,537 | B2 * | 11/2011 | Wang et al. | 16/330 |
| 8,056,186 | B2 * | 11/2011 | Zhang et al. | 16/303 |
| 8,069,534 | B2 * | 12/2011 | Wang et al. | 16/340 |
| 8,250,713 | B2 * | 8/2012 | Lin | 16/367 |
| 8,272,103 | B2 * | 9/2012 | Kim | 16/334 |
| 2005/0054393 | A1 * | 3/2005 | Fagerstrom et al. | 455/575.1 |
| 2005/0221874 | A1 * | 10/2005 | Cho et al. | 455/575.4 |
| 2006/0111160 | A1 * | 5/2006 | Lin et al. | 455/575.3 |
| 2007/0123309 | A1 * | 5/2007 | Sano et al. | 455/566 |
| 2007/0142092 | A1 * | 6/2007 | Kim | 455/566 |
| 2008/0163990 | A1 * | 7/2008 | Hammond et al. | 160/323.1 |
| 2008/0242380 | A1 * | 10/2008 | Kajihara et al. | 455/575.4 |
| 2010/0000047 | A1 * | 1/2010 | Chang | 16/334 |
| 2010/0112948 | A1 | 5/2010 | Wang et al. | |
| 2010/0162526 | A1 * | 7/2010 | Duan et al. | 16/303 |
| 2010/0319162 | A1 * | 12/2010 | Kubota et al. | 16/236 |
| 2012/0063839 | A1 * | 3/2012 | Mo | 403/84 |
| 2012/0084943 | A1 * | 4/2012 | Ahn | 16/250 |
| 2012/0140388 | A1 * | 6/2012 | Ahn | 361/679.01 |
| 2012/0211953 | A1 * | 8/2012 | Beaudoin | 280/11 |
| 2012/0212924 | A1 * | 8/2012 | Nakajima | 361/807 |
| 2012/0272481 | A1 * | 11/2012 | Ahn et al. | 16/325 |

* cited by examiner

SWIVEL HINGE APPARATUS FOR AN ELECTRONIC DEVICE

CLAIM OF PRIORITY

This application claims, pursuant to 35 USC 119(a), priority to, and the benefit of the earlier filing date of that patent application, entitled "Swivel Hinge Apparatus for Electronic Device, filed in the Korean Intellectual Property Office on Dec. 1, 2010 and assigned Serial No. 10-2010-0121144, the entire disclosure of which is incorporated by reference, herein.

BACKGROUND OF THE INVENTION

1. Field of the Invention

The present invention relates to the field of hinge mechanisms and in particular to a swivel hinge apparatus for an electronic device.

2. Description of the Related Art

As used in the context herein, the term electronic devices refer to portable communication devices, computers, portable electronic calculators, etc. The term 'portable communication device' (PCD) refers to devices carried and in some cases may perform a type of radio or wireless communication (e.g., cellular, Wi-Fi, 3G, and/or 4G. For example, portable communication devices may include a hand-held phone (HHP), cordless telephone (CT2) cellular phone, a digital phone, a personal communications systems (PCS) phone, and a personal digital assistant (PDA) and other similar types devices. For example, smartphones, such as the SAMSUNG GALAXY S, and the SAMSUNG TAB, commercially available from SAMSUNG ELECTRONICS CO., LTD., are portable communication devices. Typically, PCDs are sorted into various types according to their shapes. For example, devices (i.e., terminals) are classified based on their shape or operation. For example, terminals may be classified as a bar-type terminal, flip-type terminal, or a folder-type terminal. The bar-type terminal has a single housing shaped like a bar. The flip-type terminal has a flip or cover pivotably mounted to a bar-shaped housing by a hinge unit. The folder-type terminal has a folder coupled to a single bar-shaped housing by a hinge unit in such a manner that the folder can be rotated to fold to or unfold from the housing.

With the miniaturization of communication or receiving devices such as the portable communication devices, portable mini cassettes, MP3 players, radio players, etc., earsets connected to the electronic devices for listening have been widely used to allow the electronic devices to be easily carried.

The earset may also operate as a microphone, which may wired to device or wirelessly connected to the device. For example, a headset including a BLUETOOTH wireless transceiving (transmitting/receiving) device, with BLUETOOTH being a short range wireless communications technology at the 2.4 GHz band, commercially available from the BLUETOOTH SPECIAL INTEREST GROUP, INC., may operate to receive communications from a portable communication device or transmit communication to the portable communication device. BLUETOOTH technology is a well-known short range wireless communications technology, technology at the 2.4 GHz band, commercially available from the BLUETOOTH SPECIAL INTEREST GROUP, INC., and need not be discussed in detail herein.

A headset containing the BLUETOOTH technology, with BLUETOOTH being a short range wireless communications technology at the 2.4 GHz band, commercially available from the BLUETOOTH SPECIAL INTEREST GROUP, INC., is advantageous in that it is free from the restrictions of action and movement that exist when the earset is connected to the portable communication device by an electric wire. Moreover, a user can access the Internet and make a call or receive a call without having to access the portable communication device directly, as commands may be issued through the BLUETOOTH wireless protocol, with BLUETOOTH being a short range wireless communications technology at the 2.4 GHz band, commercially available from the BLUETOOTH SPECIAL INTEREST GROUP, INC., to the PCD.

As shown in FIG. 1, a conventional wireless headset 1 includes a BLUETOOTH module 2, with BLUETOOTH being a short range wireless communications technology at the 2.4 GHz band, commercially available from the BLUETOOTH SPECIAL INTEREST GROUP, INC., a microphone portion 3, a speaker portion 4, and a hinge apparatus 5 for rotating the speaker portion 4. The BLUETOOTH module 2, with BLUETOOTH being a short range wireless communications technology at the 2.4 GHz band, commercially available from the BLUETOOTH SPECIAL INTEREST GROUP, INC., includes at least a transceiving device that is adapted for the BLUETOOTH communication protocol, with BLUETOOTH being a short range wireless communications technology at the 2.4 GHz band, commercially available from the BLUETOOTH SPECIAL INTEREST GROUP, INC.

However, a hinge apparatus 5 of a conventional portable communication device and a hinge apparatus 5 of a conventional headset are structured such that a speaker portion 4 of the communication device and a speaker portion 4 of the headset 1 are folded or unfolded merely by being rotated in a vertical direction along the hinge apparatus 5. As a result, when the speaker portion 4 is positioned at a user's ear, a microphone portion 3 may move away from a user's mouth, such that user's sound is not accurately delivered to the partner in a communication mode. Moreover, since the speaker portion 4 linearly rotates in the vertical direction, the speaker portion 4 of the communication device and the speaker portion 4 of the headset 1 may unintentionally rotate, thus executing the communication mode, or may be closed, thus being suddenly disconnected.

Korean Patent Publication No. 2008-0107876 discloses a bending apparatus of a BLUETOOTH headset, with BLUETOOTH being a short range wireless communications technology at the 2.4 GHz band, commercially available from the BLUETOOTH SPECIAL INTEREST GROUP, INC. Referring to FIG. 2, a bending apparatus 10 of a BLUETOOTH headset, with BLUETOOTH being a short range wireless communications technology at the 2.4 GHz band, commercially available from the BLUETOOTH SPECIAL INTEREST GROUP, INC., is structured such that an earphone portion 20 and a body portion 30 coupling a left body and a right body are coupled upright, face to face, through inclined surfaces 21 and 31, and a pivoting apparatus 40 is provided in a coupling portion of the earphone portion 20 and the body portion 30 to adjust a bending angle of the earphone portion 20 according to inclinations of the inclined surfaces 21 and 31.

However, the conventional bending apparatus 10 of the BLUETOOTH headset, with BLUETOOTH being a short range wireless communications technology at the 2.4 GHz band, commercially available from the BLUETOOTH SPECIAL INTEREST GROUP, INC., is structured such that the pivoting apparatus 40 is mounted along the inclined surfaces 21 and 31 of the earphone portion 20 and the body portion 30. As a result, the pivoting apparatus 40 is separated along the inclined surfaces 21 and 31, thus being difficult to install and reducing an applicable force for retaining the pieces in position, whereby the strength of engagement and assembly processing of a product are difficult and a time for assembly processing also increases.

Therefore, there is a need for an apparatus which assembles a hinge apparatus to an electronic device in a simple and easy way and improves the strength of engagement.

SUMMARY OF THE INVENTION

Accordingly, an aspect of the present invention is to provide a swivel hinge apparatus for an electronic device in which engagement portions of the swivel hinge apparatus are bent to be inclined at a predetermined angle, thereby improving the strength of engagement of the swivel hinge apparatus with respect to the electronic device and facilitating assembly processing.

Another aspect of the present invention is to provide a swivel hinge apparatus for an electronic device in which a plurality of hinge members are inclined, thereby improving rotation of an element of the product with respect to another element and further improving the strength of engagement of the swivel hinge apparatus.

According to an aspect of the present invention, there is provided a swivel hinge apparatus for an electronic device that includes a first housing having a first inclined surface formed thereon and a second housing having a second inclined surface formed thereon, the second housing rotating in a bent manner while facing the first inclined surface. The swivel hinge apparatus includes a first hinge member that is inclined, a second hinge member that is inclined and is coupled with the first hinge member to rotate while facing the first hinge member, a guide portion provided between the first hinge member and the second hinge member to guide rotation of the second hinge member, an elastic member provided on a rear side of the first hinge member to provide an elastic force for allowing rotation and linear movement of the first hinge member and the second hinge member, and a shaft from which a cylindrical housing protrudes, the cylindrical housing being coupled with the first hinge member, the second hinge member, the elastic member, and a support cover portion by passing through them.

According to another aspect of the present invention, there is provided a swivel hinge apparatus for an electronic device that includes a first housing having a first inclined surface formed thereon and a second housing having a second inclined surface formed thereon, the second housing rotating in a bent manner while facing the first inclined surface. The swivel hinge apparatus includes a first hinge member that faces the first inclined surface and the second inclined surface and has formed therein a first engagement portion that is bent, a second hinge member that faces the first inclined surface and the second inclined surface, has a cylindrical housing protruding therefrom, and has formed therein a second engagement portion that is bent and is coupled with the first hinge member to rotate around a hinge axis while facing the first hinge member, a guide stopper portion provided between the first hinge member and the second hinge member to guide and restrict rotation of the second hinge member, an elastic member provided in the first hinge member to provide an elastic force for allowing rotation and linear movement of the first hinge member and the second hinge member, a washer that is coupled with and supports the elastic member, and an E-ring engaged with an end portion of the cylindrical housing.

According to another aspect of the invention, an electronic device comprising first and second housings joined along inclined surfaces by a hinge apparatus. The hinge apparatus comprising a first hinge member, a second hinge member that rotates around a hinge axis normal to at least one of a first inclined surface and a second inclined surface while facing the first hinge member; a guide stopper portion provided between the first hinge member and the second hinge member to guide and restrict rotation of the second hinge member; an elastic member provided in the first hinge member to provide an elastic force for allowing rotation and linear movement of the first hinge member and the second hinge member; a washer which is coupled with and supports the elastic member; and an E-ring engaged with an end portion of the cylindrical housing.

BRIEF DESCRIPTION OF THE DRAWINGS

The above and other features and advantages of exemplary embodiments of the present invention will be more apparent from the following detailed description taken in conjunction with the accompanying drawings, in which.

DETAILED DESCRIPTION

Figure 1:
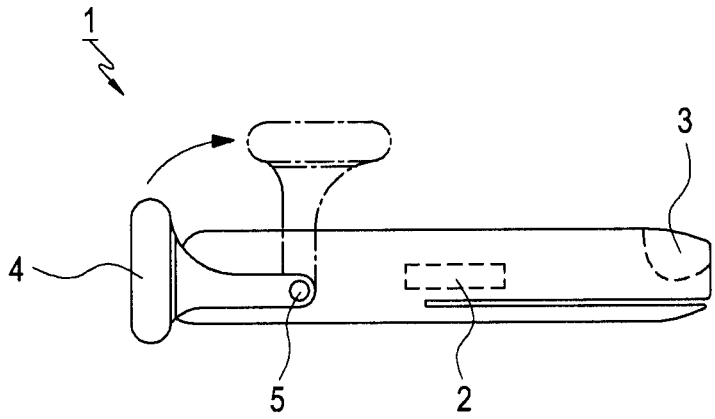
FIG.1 (PRIOR ART)
FIG. 1 is a side cross-sectional view of a conventional headset having BLUETOOTH technology embedded therein, with BLUETOOTH being a short range wireless communications technology at the 2.4 GHz band, commercially available from the BLUETOOTH SPECIAL INTEREST GROUP, INC.
Figure 2:
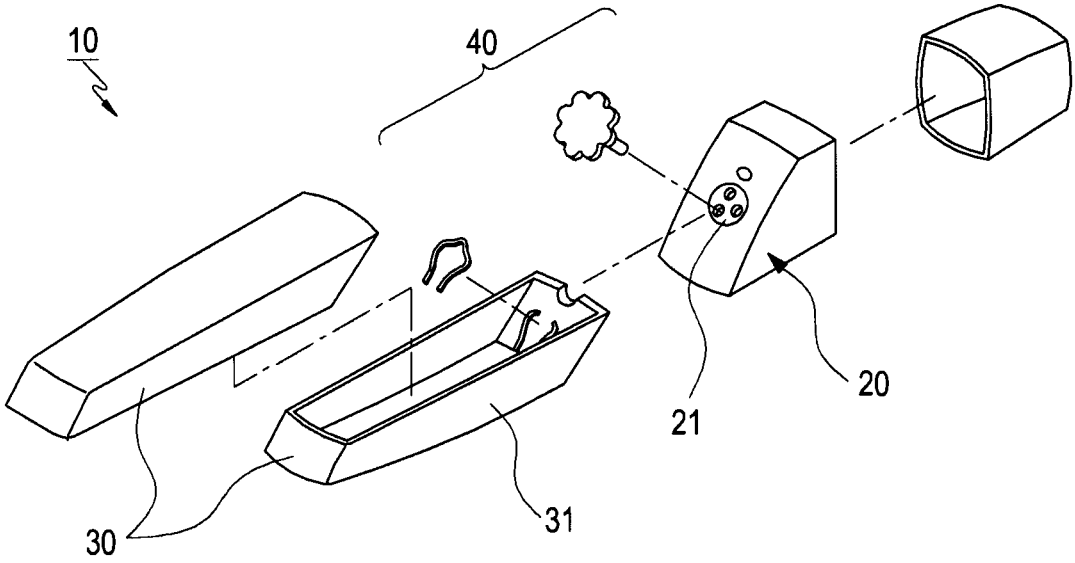
FIG.2 (PRIOR ART)
FIG. 2 is an exploded perspective view of a conventional swivel hinge apparatus.

Exemplary embodiments of the present invention will be described in detail with reference to the accompanying drawings. The embodiments disclosed in the specification and structures shown in the drawings are merely exemplary ones of the present invention, and it should be understood that various variations capable of substituting for the embodiments may exist at the time of filing the application.

As shown in FIGS. 3 through 11, which represent a first embodiment of the invention claimed, a swivel hinge apparatus 100 for an electronic device includes a first housing 110 having a first inclined surface 111 formed thereon, a second housing 120 having a second inclined surface 121 formed thereon, a first hinge member 130 having a bent first engagement portion 131 formed thereon, a second hinge member 140 having a bent second engagement portion 141 formed thereon, a guide portion 150, an elastic member 160, a support cover portion 170, and a shaft 180 having a protruding cylindrical housing 181 formed thereon.

Figure 6:
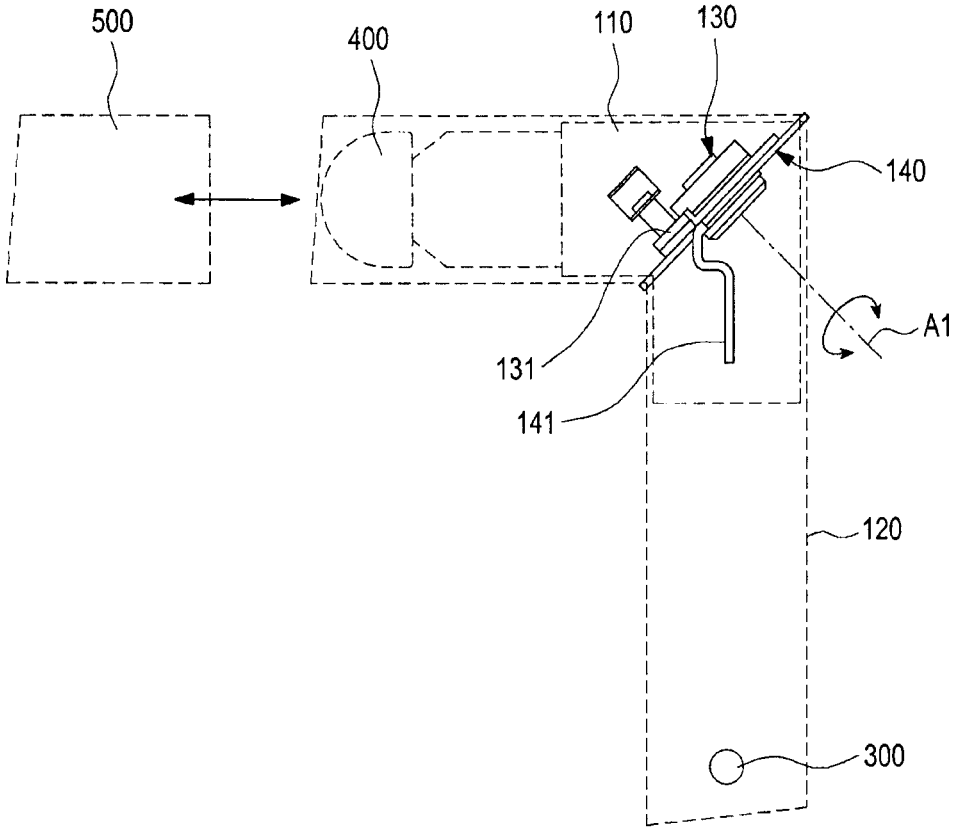
FIG. 6 is a side view showing a post-operation state (after-operation state) of a swivel hinge apparatus for an electronic device according to the first embodiment of the present invention.

The first housing 110 is coupled with the second inclined surface 121 of the second housing 120 (FIG. 3) in a way to rotate around a hinge axis A1 (which is perpendicular or normal to the inclined surface of the first or second housing, see FIG. 6), so that the first housing 110 can support the rotation of the second housing 120 while facing the second inclined surface 121 of the second housing 120. The second housing 120 is rotatably coupled to the first inclined surface 111 of the first housing 110, so that the second housing 120 can rotate in a manner around the hinge axis A1 while facing the first inclined surface 111 of the first housing 110. The first hinge member 130 faces the first inclined surface 111 and the second inclined surface 121, is inclinedly bent, and is engaged with an end portion of the first housing 110 by the bent first engagement portion 131 to support the rotation of the second hinge member 140. The second hinge member 140 faces the first inclined surface 111 and the second inclined surface 121, is inclinedly bent, and is engaged with an end portion of the second housing 120 by the bent second engagement portion 141. The guide portion 150 is provided between the first hinge member 130 and the second hinge member 140 to guide the rotation of the second hinge member 140. The elastic member 160 is provided on a rear side of the first hinge member 130 to provide an elastic force for allowing linear movement of the first hinge member 130 along the hinge axis A1 and an elastic force for allowing rotation of the second hinge member 140 around the first hinge axis A1. The shaft 180 is coupled with the first hinge member 130, the second hinge member 140, the elastic member 160, and the support cover portion 170 by passing them therethrough.

Figure 3:
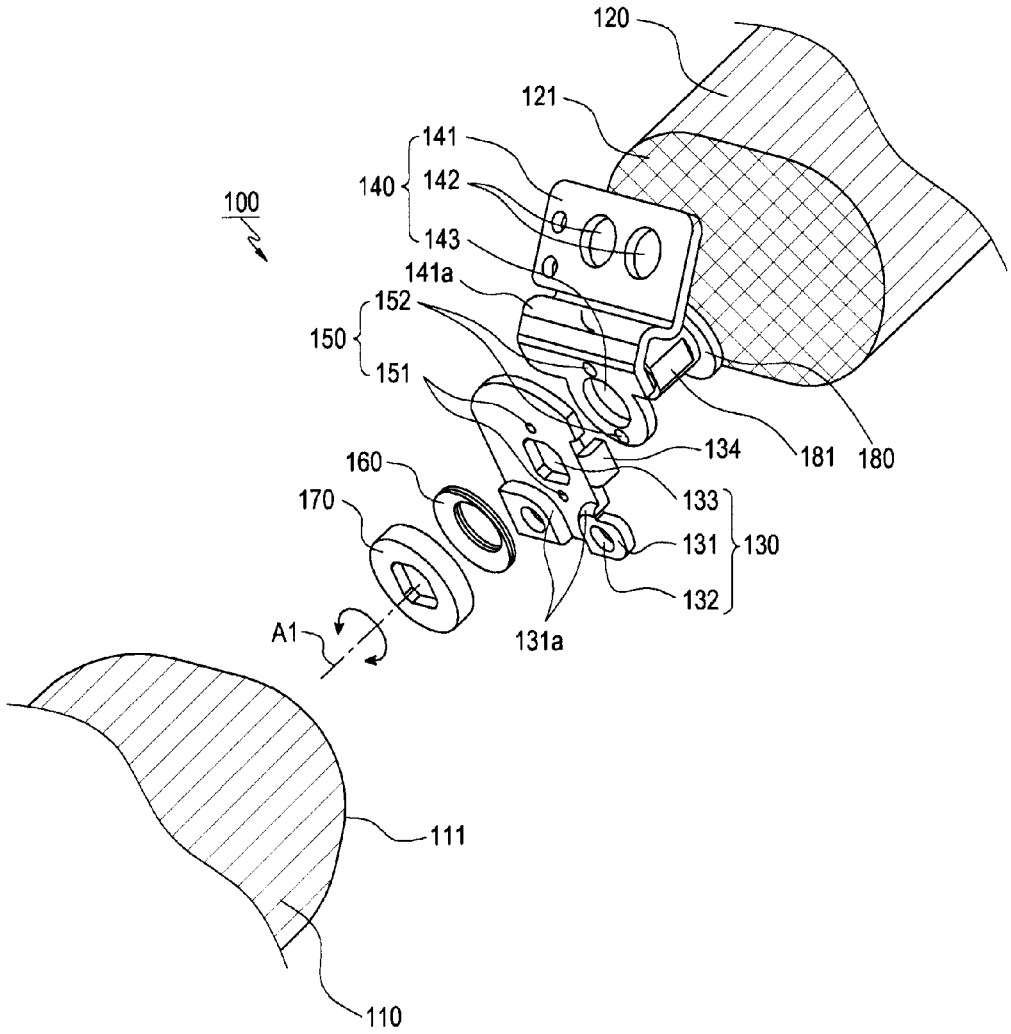
FIG. 3 is an exploded perspective view of a swivel hinge apparatus for an electronic device according to a first embodiment of the present invention.

As shown in FIG. 3, the first hinge member 130 includes the first engagement portion 131, at least one engagement hole 132, and a through-hole 133. The first engagement portion 131 has bent portions 131 a formed therein, and is engaged with the first housing 110. The first engagement portion 131 is formed in the first hinge member 130 such that the first hinge member 130 is bent in a longitudinal direction of the first housing 110 while facing the first inclined surface 111 and the second inclined surface 121. The engagement holes 132 are formed in the first engagement portion 131 for engaging with the first housing 110, and the through-hole 133 is formed in the first hinge member 130 to pass the cylindrical housing 181 therethrough.

As shown in FIG. 3, the second hinge member 140 includes the second engagement portion 141, at least one engagement hole 142, and a rotation hole 143. The second engagement portion 141 has a bent portion 141*a* formed therein and is coupled with the second housing 120. The second engagement portion 141 is formed in the second hinge member 140 such that the second hinge member 140 is bent along a longitudinal direction of the second housing 120 while facing the first inclined surface 111 and the second inclined surface 121. The engagement holes 142 are formed in the second engagement portion 141 for engagement with the second housing 120, and the rotation hole 143 is formed in the second hinge member 140 to be rotatably coupled with the cylindrical housing 181 while passing the cylindrical housing 181 therethrough.

Figure 7:
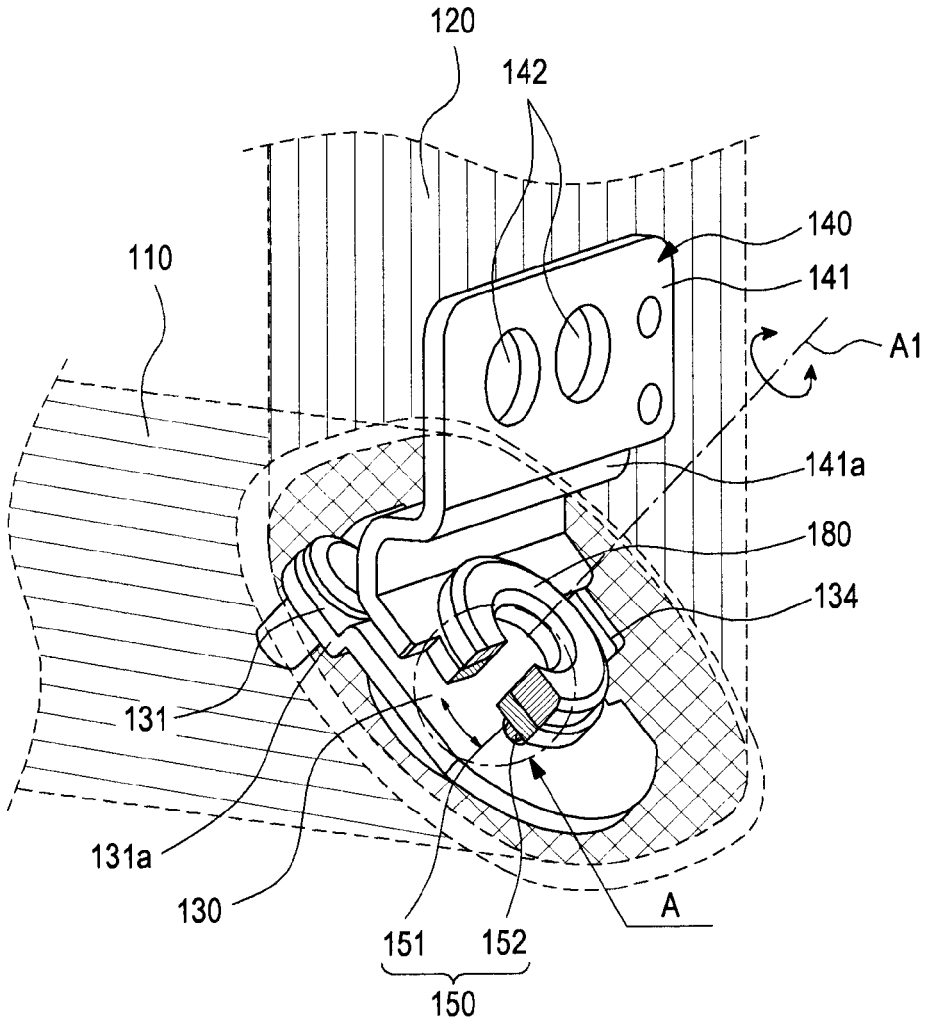
FIG. 7 is an enlarged perspective view showing a post-operation state of a swivel hinge apparatus for an electronic device according to the first embodiment of the present invention.
Figure 8:
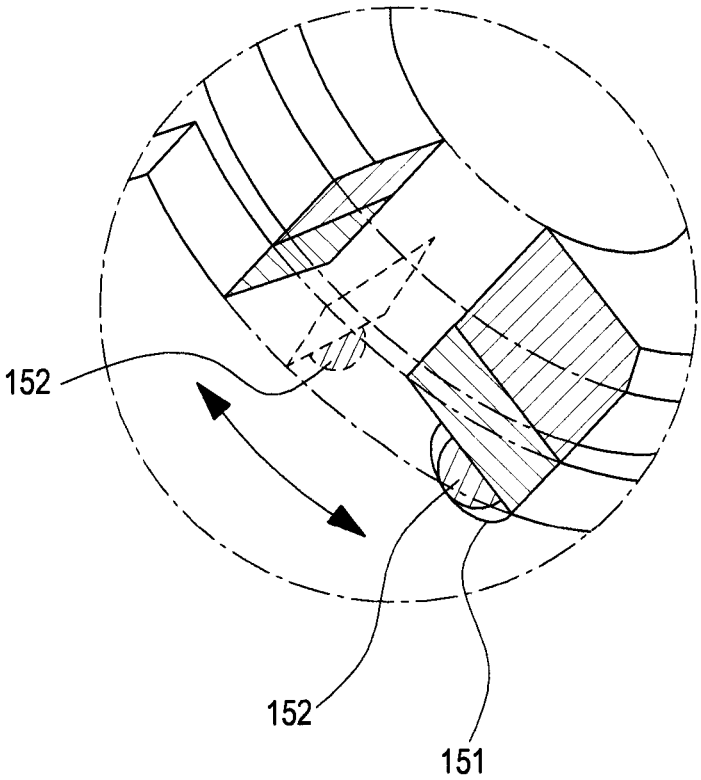
FIG. 8 is an enlarged perspective view of a portion A of FIG. 7.

As shown in FIGS. 3, 7, and 8, the guide portion 150 includes at least one engagement/disengagement hole 151 and at least one hemispheric emboss portion 152. The engagement/disengagement holes 151 are formed in the first hinge member 130 to correspond to the hemispheric emboss portions 152, and the hemispheric emboss portions 152 protrude from the second hinge member 140 to be engaged with or disengaged from the engagement/disengagement holes 151 and to provide a clicking sense in an initial position or end position of the second hinge member 140.

As shown in FIG. 3, the elastic member 160 includes a disc spring. However, it would be recognized that other forms of elastic members, e.g., twist springs, may be used without altering the scope of the invention claimed.

As shown in FIGS. 3 through 9, in the first hinge member 130 is formed a stopper protrusion 134 for stopping rotation of the second hinge member 140 by contacting the second hinge member 140.

The swivel hinge apparatus according to an embodiment of the present invention can be applied to an electronic device as a representative example. However, the present invention may be applied to various types of terminals adopting a swivel hinge apparatus without being limited to an electronic device.

Examples of the electronic device according to an embodiment of the present invention may include not only mobile communication terminals or PCDs operating in accordance with communication protocols corresponding to various communication systems, but also any information communication apparatus or multimedia apparatus, such as headsets having BLUETOOTH functions, with BLUETOOTH being a short range wireless communications technology at the 2.4 GHz band, commercially available from the BLUETOOTH SPECIAL INTEREST GROUP, INC., Portable Multimedia Players (PMPs), MP3 players, game players, notebooks, advertisement boards, digital broadcasting players, Personal Digital Assistants (PDAs), and smart phones, and so forth, and their application apparatuses.

As shown in FIG. 6, in case of a communication headset, the embedded BLUETOOTH technology device (not shown) , with BLUETOOTH being a short range wireless communications technology at the 2.4 GHz band, commercially available from the BLUETOOTH SPECIAL INTEREST GROUP, INC., is turned on when the second housing 120 rotates around the hinge axis A1 into a second position, and the embedded BLUETOOTH technology device is turned off, with BLUETOOTH being a short range wireless communications technology at the 2.4 GHz band, commercially available from the BLUETOOTH SPECIAL INTEREST GROUP, INC., when the second housing 120 rotates to an original or first position. In the illustrated example of a headset device shown in FIG. 4, for example, an original position may be when the first and second housings are linearly joined along a longitudinal axis (i.e., zero degree rotation). In this original or first position, the embedded BLUETOOTH technology device is turned off, with BLUETOOTH being a short range wireless communications technology at the 2.4 GHz band, commercially available from the BLUETOOTH SPECIAL INTEREST GROUP, INC. However, as shown in FIG. 6, when the second housing is rotated to form a ninety (90) degree angle, then the embedded BLUETOOTH technology device is turned on, with BLUETOOTH being a short range wireless communications technology at the 2.4 GHz band, commercially available from the BLUETOOTH SPECIAL INTEREST GROUP, INC. In this illustrative example, the first housing 110 and the second housing 120 form an "L" shape as the second housing 120 rotates 180 degrees in a bent manner.

Figure 10:
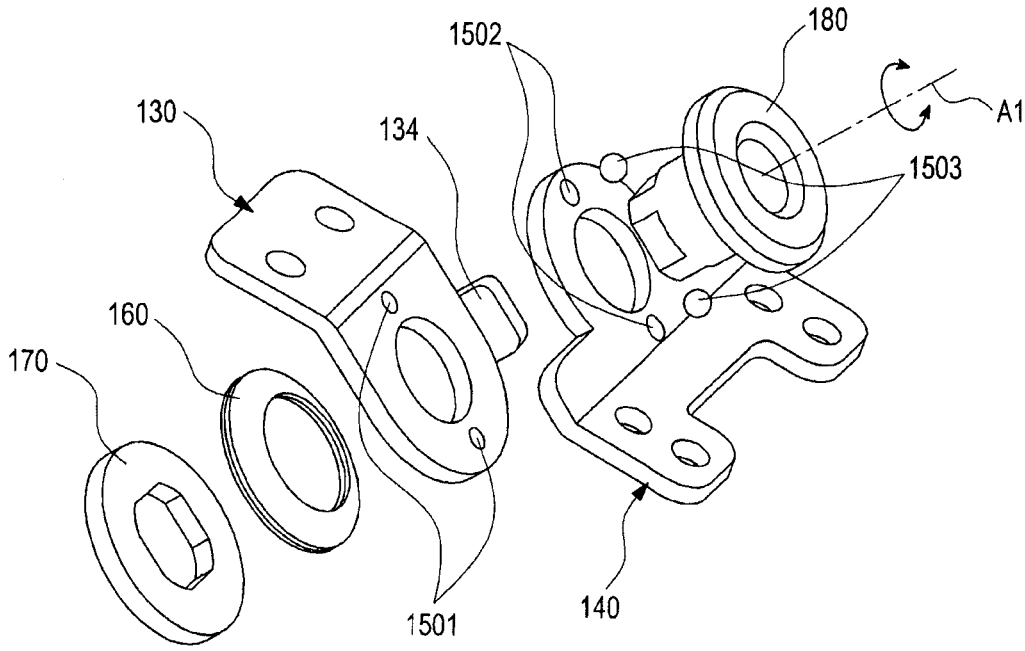
FIG. 10 is an exploded perspective view showing another example of a guide portion of a swivel hinge apparatus for an electronic device according to the first embodiment of the present invention.
Figure 11:
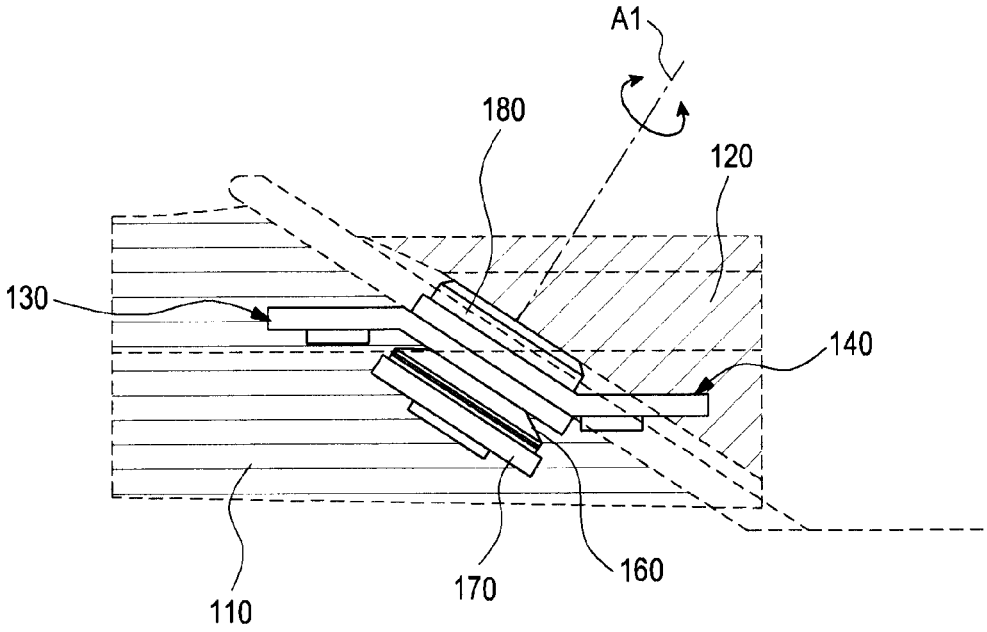
FIG. 11 is a side view showing another example of a guide portion of a swivel hinge apparatus for an electronic device according to the first embodiment of the present invention.

Shown in FIGS. 10 and 11 is another example of the guide portion 150 which includes at least one engagement/disengagement holes 1501, at least one ball hole 1502, and at least one ball 1503.

As shown in FIG. 10, the engagement/disengagement holes 1501 are formed in the first hinge member 130 to correspond to the balls 1503. The ball holes 1502 are formed in the second hinge member 140 to pass the balls 1503 therethrough and allow the balls 1503 to correspond to the engagement/disengagement holes 1501. The balls 1503 are coupled with the ball holes 1502 by passing through the ball holes 1502, such that the balls 1503 closely contact the engagement/disengagement holes 1501 and are engaged with or disengaged from the engagement/disengagement holes 1501 by rotation of the second hinge member 140 to provide a clicking sense in a rotation initial or end position of the second hinge member 140. Although there is illustrated a pair of balls and corresponding ball holes, it would be recognized that the invention operates in a similar manner whether there is one ball and corresponding hole or a plurality of balls and corresponding balls. The pair illustrated is only for purposes of presenting the subject matter claimed in a manner that would enable one skilled in the art to practice the invention described without undue experimentation.

With reference to FIGS. 3 through 11, a detailed description will be made of an operating process of the above-described swivel hinge apparatus for an electronic device according to a first embodiment of the present invention.

As shown in FIGS. 3 through 9, the swivel hinge apparatus 100 includes the first housing 110 having the first inclined surface 111 formed thereon, the second housing 120 having the second inclined surface 121 formed thereon, the first hinge member 130 having the bent first engagement portion 131 formed thereon, the second hinge member 140 having the bent second engagement portion 141 formed thereon, the guide portion 150, the elastic member 160, the support cover portion 170, and the shaft 180 having the protruding cylindrical housing 181 formed thereon.

As shown in .FIGS. 3 through 6, and referring to a headset 101 having BLUETOOTH technology embedded therein, with BLUETOOTH being a short range wireless communications technology at the 2.4 GHz band, commercially available from the BLUETOOTH SPECIAL INTEREST GROUP, INC., as a representative example of the electronic device, the first housing 110 includes a speaker portion 400 (FIG. 6) and the second housing 120 includes a microphone portion 300 (FIG. 6).

As shown in FIGS. 3 through 9, the through-hole 133 formed in the first hinge member 130 is coupled with the cylindrical housing 181 having the shaft 180 formed therein by passing the cylindrical housing 181 therethrough. The cylindrical housing 181 is also coupled with the rotation hole 143 formed in the second hinge member 140 in a way to rotate around the hinge axis A1, and is then coupled with the elastic member 160 and the support cover portion 170 by passing through the elastic member 160 and the support cover portion 170.

As shown in FIGS. 3, 7, and 8, the guide portion 150 includes the at least one engagement/disengagement hole 151 and the at least one hemispheric emboss portion 152. The first hinge member 130 and the second hinge member 140 are coupled to each other while facing each other, and the hemispheric emboss portions 152 are inserted into the engagement/disengagement holes 151.

In this state, as shown in FIGS. 3 through 9, the first engagement portion 131 of the first hinge member 130 is engaged with the first housing 110 and the second engagement portion 141 of the second hinge member 140 is engaged with the second housing 120.

Figure 4:
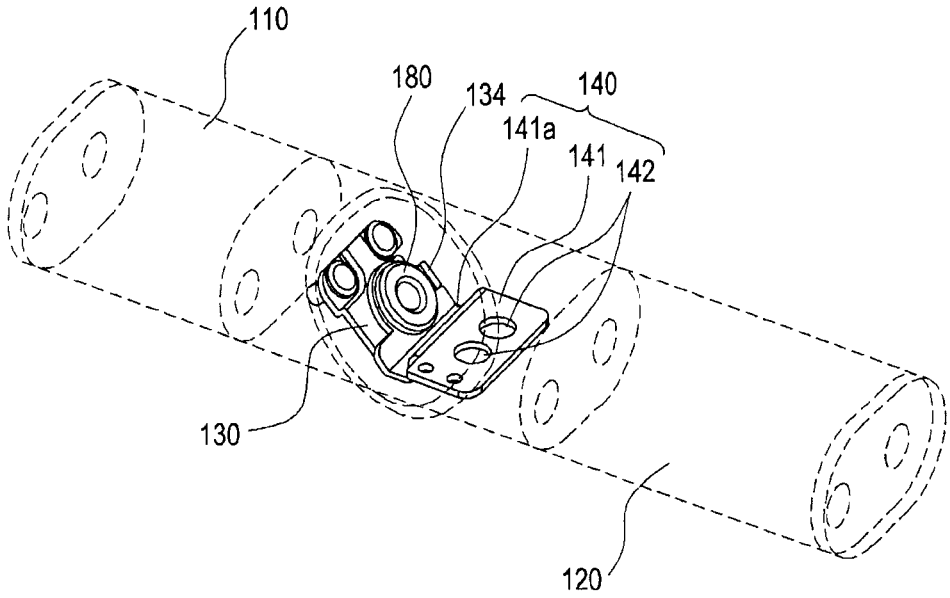
FIG. 4 is a perspective view showing a coupled state of a swivel hinge apparatus for an electronic device according to the first embodiment of the present invention.
Figure 5:
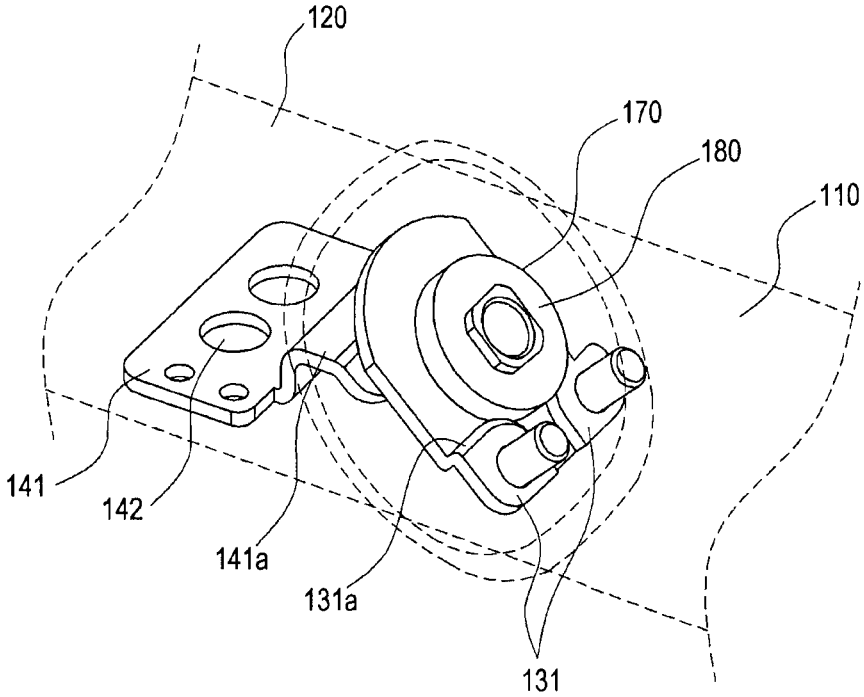
FIG. 5 is an enlarged perspective view showing a rear side of a coupled state of a swivel hinge apparatus for an electronic device according to the first embodiment of the present invention.

As shown in FIGS. 3 through 5, the first engagement portion 131 and the second engagement portion 141 of the first hinge member 130 and the second hinge member 140, which correspond to the first inclined surface 111 and the second inclined surface 121 of the first housing 110 and the second housing 120 respectively, are bent, and engaged along a longitudinal direction of the first housing 110 and the second housing 120, thereby facilitating engagement with the first housing 110 and the second housing 120 and improving the strength of the engagement.

As shown in FIGS. 6 through 9, when the second housing 120 rotates from the first housing 110 around the hinge axis A1, a cap 500 coupled with the second housing 120 is removed from the second housing 120. In this state, the second hinge member 140 rotates and the hemispheric emboss portions 152 of the guide portion 150 also rotate.

As shown in FIGS. 7 and 8, the hemispheric emboss portions 152 leave the engagement/disengagement holes 151 and are inserted into the engagement/disengagement holes 151 again in the rotation end position of the second hinge member 140, while providing a clicking sense.

As shown in FIG. 7, the elastic member 160 provides an elastic force for allowing linear movement of the first hinge member 130 along the hinge axis A1, and an elastic force for allowing linear movement of the engagement/disengagement holes 151 of the first hinge member 130 such that the engagement/disengagement holes 151 are engaged with or disengaged from the hemispheric emboss portions 152. The elastic member 160 provides an elastic force for allowing rotation of the second hinge member 140 around the hinge axis A1.

Figure 9:
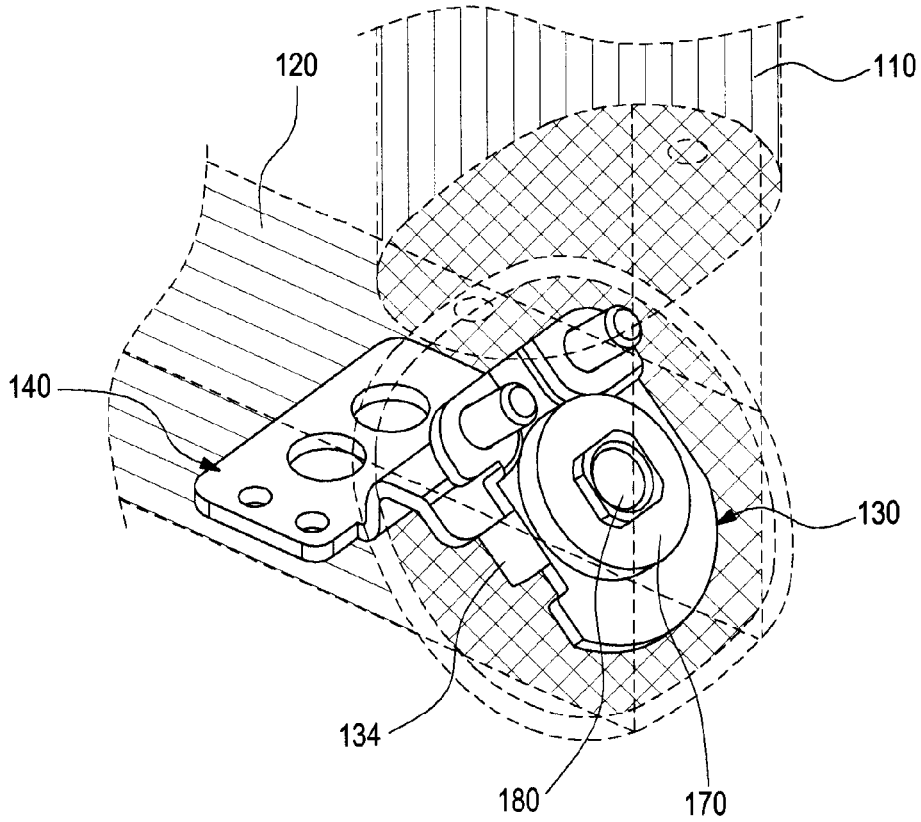
FIG. 9 is an enlarged perspective view showing an operation state of a stopper protrusion of a swivel hinge apparatus for an electronic device according to the first embodiment of the present invention.

As shown in FIGS. 7 through 9, the second hinge member 140 rotates around the hinge axis A1 and contacts the stopper protrusion 134 formed on the first hinge member 130, such that rotation of the second hinge member 140 is restricted.

As shown in FIGS. 5 through 7, the first housing 110 and the second housing 120 form an "L" shape as the second housing 120 rotates 180 degrees with respect to the first housing. In this state, the speaker portion 400 provided in the first housing 110 is inserted into a user's ear and the microphone portion 300 provided in the second housing 120 is brought in close contact with a user's mouth.

Herein, when the second housing 120 rotates 180 degrees around the hinge axis A1, the embedded BLUETOOTH technology, with BLUETOOTH being a short range wireless communications technology at the 2.4 GHz band, commercially available from the BLUETOOTH SPECIAL INTEREST GROUP, INC., is turned on and thus the headset 101 is used; when the second housing 120 rotates to the original position, the embedded BLUETOOTH technology, with BLUETOOTH being a short range wireless communications technology at the 2.4 GHz band, commercially available from the BLUETOOTH SPECIAL INTEREST GROUP, INC., is turned off and thus the headset 101 does not operate.

As shown in FIGS. 4 through 6, to rotate the second housing 120 to the original position, the second hinge member 140 rotates around the hinge axis A1 again, together with the hemispheric emboss portions 152. If the second hinge member 140 rotates to the rotation initial position around the hinge axis A1, the hemispheric emboss portions 152 leave the engagement/disengagement holes 151, thus providing a clicking sense in the rotation initial position.

Shown in FIGS. 10 and 11 is another example of the guide portion 150 which includes the at least one engagement/disengagement hole 1501, the at least one ball hole 1502, and the at least one ball 1503.

As shown in FIG. 10, the engagement/disengagement holes 151 are formed in the first hinge member 130 to correspond to the balls 1503. The ball holes 1502 are formed in the second hinge member 140 to pass the balls 1503 therethrough and allow the balls 1503 to correspond to the engagement/disengagement holes 1501.

As shown in FIG. 10, the balls 1503 are coupled with the ball holes 1502 by passing through the ball holes 1502, such that the balls 1503 closely contact the engagement/disengagement holes 1501 and are engaged with or disengaged from the engagement/disengagement holes 1501 by rotation of the second hinge member 140 to provide a clicking sense in the rotation initial or end position of the second hinge member 140. In this state, by rotating the second housing 120 around the hinge axis A1, the second hinge member 140 also rotates and the balls 1503 also rotate and leave the engagement/disengagement holes 151. The balls 1503 are inserted into the engagement/disengagement holes 151 again in the rotation end position of the second hinge member 140, thus providing a clicking sense.

Once the second hinge member 140 rotates around the hinge axis A1 again to rotate the second housing 120 to the original position, the second hinge member 140 also rotates and the balls 1503 rotate and leave the engagement/disengagement holes 151, such that the balls 1503 are inserted again into the engagement/disengagement holes 151 in the rotation initial position of the second hinge member 140, thus providing a clicking sense.

With reference to FIGS. 12 through 19, a detailed description will be made of an operating process of the above-described swivel hinge apparatus for an electronic device according to a second embodiment of the present invention.

As shown in FIGS. 12 through 19, a swivel hinge apparatus 200 includes the first housing 110 having the first inclined surface 111 formed thereon, the second housing 120 having the second inclined surface 121 formed thereon, a first hinge member 210 having a bent first engagement portion 211 formed thereon, a second hinge member 220 having a bent second engagement portion 221 formed thereon, a guide stopper portion 230, an elastic member 240, a washer 250, and an E-ring 260.

As shown in FIGS. 12 through 19, the first housing 110 is coupled with the second inclined surface 121 of the second housing 120 in a way to rotate around the hinge axis A1, so that the first housing 110 can support bent rotation of the second housing 120 while facing the second inclined surface 121 of the second housing 120. The second housing 120 is rotatably coupled to the first inclined surface 111 of the first housing 110, so that the second housing 120 can rotate in a bent manner around the hinge axis A1 while facing the first inclined surface 111 of the first housing 110. The first hinge member 210 faces the first inclined surface 111 and the second inclined surface 121, is inclinedly bent, and is engaged with an end portion of the first housing 110 by the bent first engagement portion 211 to support the rotation of the second hinge member 220. The second hinge member 220 faces the first inclined surface 111 and the second inclined surface 121, is inclinedly bent, and is engaged with an end portion of the second housing 120 by the bent second engagement portion 221, such that the second hinge member 220 is coupled with the first hinge member 210 in a way to rotate while facing the first hinge member 210. In the second hinge member 220 is formed a cylindrical housing 223 to be coupled with the first hinge member 210, the elastic member 240, the washer 250, and the E-ring 260. The guide stopper portion 230 is provided between the first hinge member 210 and the second hinge member 220 to guide and restrict rotation of the second hinge member 220. The elastic member 240 is provided on a rear side of the first hinge member 210 to provide an elastic force for allowing linear movement of the first hinge member 210 along the hinge axis A1 and an elastic force for allowing rotation of the second hinge member 220 around the first hinge axis A1. The washer 250 is provided in the first hinge member 210 to be coupled with and support the elastic member 240. The E-ring 260 is engaged with an end portion of the cylindrical housing 223 to allow rotation of the first hinge member 210 and the second member 220, couple them with each other, and couple the elastic member 240 with the washer 250.

Figure 12:
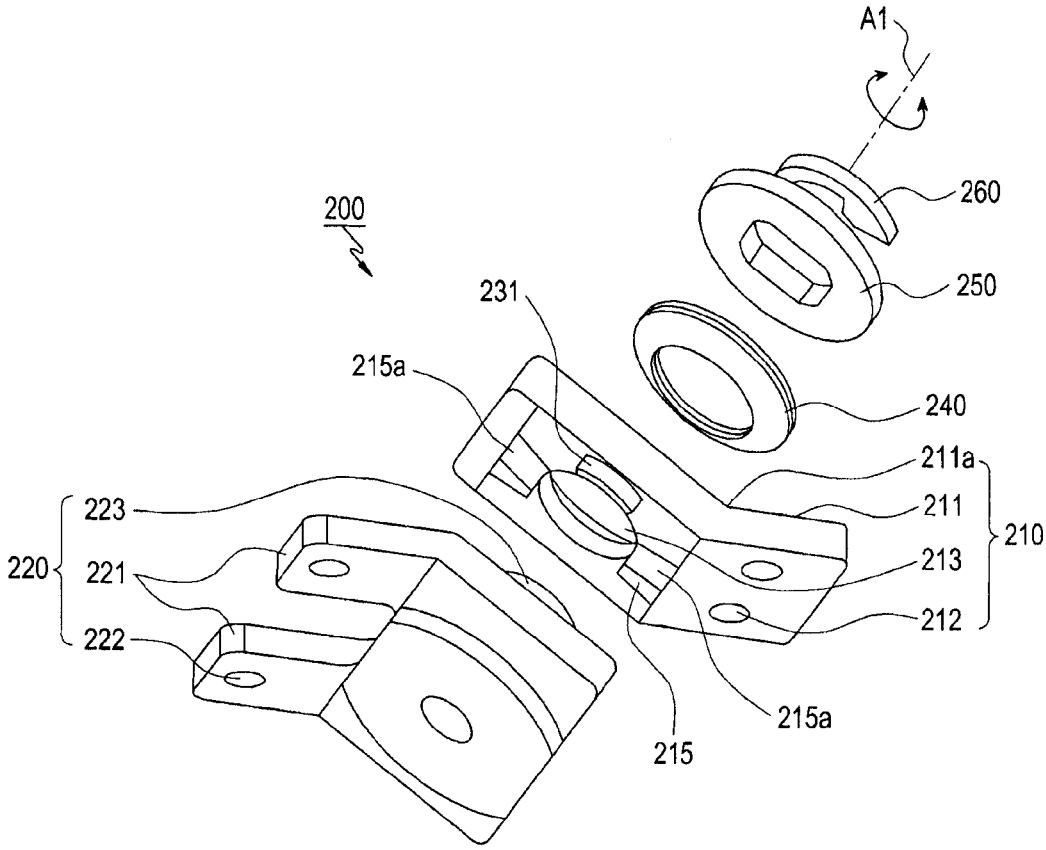
FIG. 12 is an exploded perspective view of a swivel hinge apparatus for an electronic device according to a second embodiment of the present invention.
Figure 13:
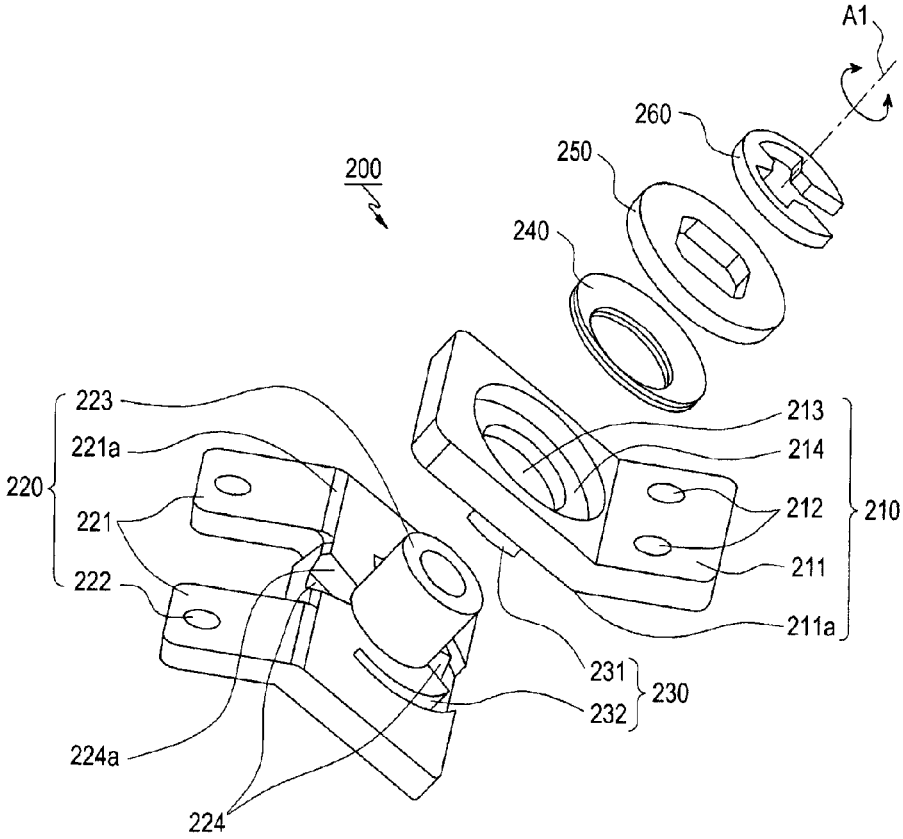
FIG. 13 is an exploded perspective view showing an internal structure of a swivel hinge apparatus for an electronic device according to the second embodiment of the present invention.
Figure 14:
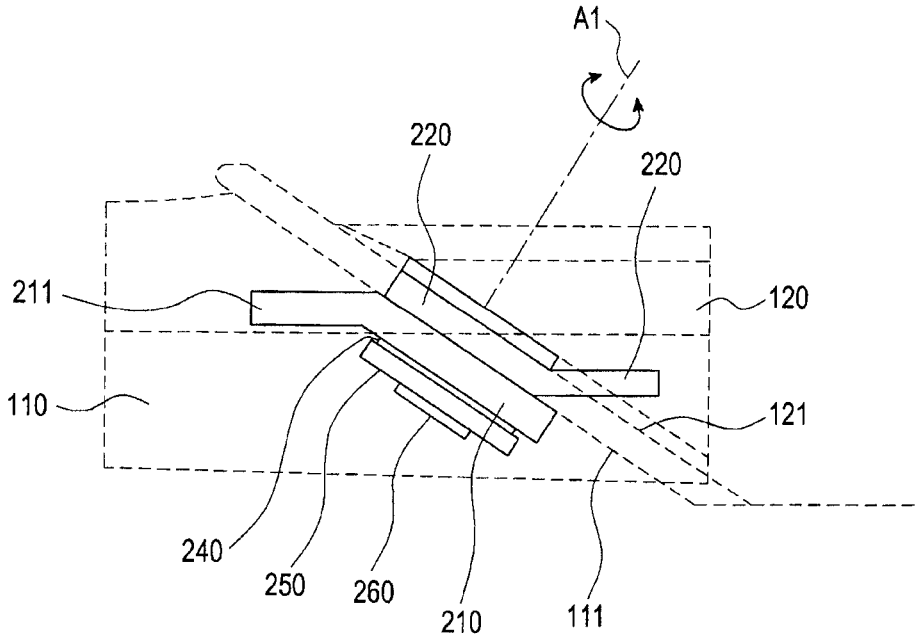
FIG. 14 is a side view of a swivel hinge apparatus for an electronic device according to the second embodiment of the present invention.

As shown in FIGS. 12 through 14, the first hinge member 210 includes the first engagement portion 211, at least one engagement holes 212, a through-hole 213, and a coupling recess 214. The first engagement portion 211 has formed a bent portion 211*a* therein, is engaged with the first housing 110, and is formed in the first hinge member 210 such that the first hinge member 210 is bent in the longitudinal direction of the first housing 210 while facing the first inclined surface 111 and the second inclined surface 121. The engagement holes 212 are formed in the first engagement portion 211 to be engaged with the first housing 110, and the through-hole 213 is formed in the first hinge member 210 to pass the cylindrical housing 223 therethrough. The coupling recess 214 is formed in the first hinge member 210 to be coupled with the elastic member 240 and the washer 250.

As shown in FIGS. 12 through 14, the second hinge member 220 includes the second engagement portion 221, at least one engagement hole 222, and the cylindrical housing 223. The second engagement portion 221 has a bent portion 221*a* formed therein and is coupled with the second housing 120.

The second engagement portion 221 is formed in the second hinge member 220 such that the second hinge member 220 is bent along a longitudinal direction of the second housing 120 while facing the first inclined surface 111 and the second inclined surface 121. The engagement holes 222 are formed in the second engagement portion 221 for engagement with the second housing 120, and the cylindrical housing 223 is formed on the second hinge member 220 to pass through the elastic member 240, the washer 250, and the through-hole 213 of the first engagement portion 211.

As shown in FIGS. 12, 13, 18, and 19, the guide stopper portion 230 includes a guide cam 231 and a stopper groove 232. The guide cam 231 is formed in the first hinge member 210 to be inserted into the stopper groove 232. The stopper groove 232 is coupled with and guides the guide cam 231, and is formed in the second hinge member 220 such that the stopper groove 232 contacts the guide cam 231 in the rotation initial or end position of the second hinge member 220 to restrict rotation of the second hinge member 220. On an end portion of the stopper groove 232 is formed a first stopper portion 232*a* for restricting rotation of the second hinge member 220 by contacting the guide cam 231 in the rotation initial position of the second hinge member 220. On the other end portion of the stopper groove 232 is formed a second stopper portion 232*b* for restricting rotation of the second hinge member 220 by contacting the guide cam 231 in the rotation end position of the second hinge member 220.

As shown in FIGS. 12, 13, 18, and 19, in the second hinge member 220 are formed a pair of click grooves 224 that engage with or disengage from a pair of click protrusions 215 protruding from the first hinge member 210 during rotation of the second hinge member 220 to provide a clicking sense in the rotation initial or end position of the second hinge member 220. Although there is illustrated a pair of click grooves and corresponding click protrusions, it would be recognized that the invention operates in a similar manner whether there is one click groove and corresponding protrusion or a plurality of click grooves and corresponding protrusions. The pair illustrated is only for purposes of presenting the subject matter claimed in a manner that would enable one skilled in the art to practice the invention described without undue experimentation.

As shown in FIGS. 12 and 13, the click protrusions 215 and the click grooves 224 are provided with guide inclined surfaces 215*a* and a guide inclined surface 224*a*, respectively, to facilitate engagement/disengagement.

The elastic member 240 includes a disc spring.

The swivel hinge apparatus according to an embodiment of the present invention can be applied to an electronic device as a representative example. However, the present invention may be applied to various types of terminals adopting a swivel hinge apparatus without being limited to an electronic device.

The electronic device may be a portable communication device or a headset having BLUETOOTH embedded therein, with BLUETOOTH being a short range wireless communications technology at the 2.4 GHz band, commercially available from the BLUETOOTH SPECIAL INTEREST GROUP, INC.

As shown in FIGS. 12 through 19, the swivel hinge apparatus 200 includes the first housing 110 having the first inclined surface 111 formed thereon, the second housing 120 having the second inclined surface 121 formed thereon, the first hinge member 210 having the inclinedly bent first engagement portion 211 formed thereon, the second hinge member 220 having the inclinedly bent second engagement portion 221 formed thereon, the guide stopper portion 230, the elastic member 240, the washer 250, and the E-ring 260.

Figure 16:
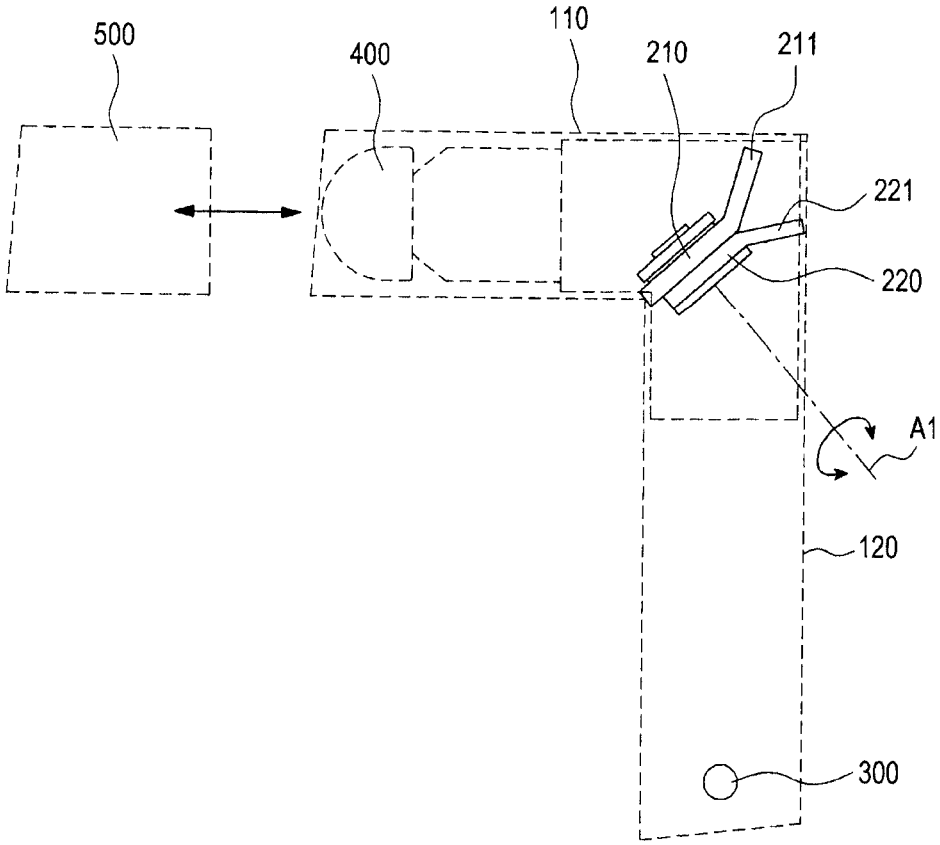
FIG. 16 is a side view showing a post-operation state (after-operation state) of a swivel hinge apparatus for an electronic device according to the second embodiment of the present invention.

Herein, as shown in FIG. 16, in case of the headset 101 having BLUETOOTH embedded therein, with BLUETOOTH being a short range wireless communications technology at the 2.4 GHz band, commercially available from the BLUETOOTH SPECIAL INTEREST GROUP, INC., as a representative example of the electronic device, the speaker portion 400 is provided in the first housing 110 and the microphone portion 300 is provided in the second housing 120.

As shown in FIGS. 12 and 13, the cylindrical housing 223 formed in the second hinge member 220 is coupled with the through-hole 213 formed in the first hinge member 210 such that the cylindrical housing 223 passes through the through-hole 213 and rotates around the hinge axis A1. The cylindrical housing 223 is also coupled with the elastic member 240 and the washer 250 by passing through the elastic member 240 and the washer 250. The E-ring 260 is engaged with an end portion of the cylindrical housing 223 protruding through the washer 250.

As shown in FIGS. 12, 13, 18, and 19, the guide stopper portion 230 includes the guide cam 231 and the stopper groove 232. The first hinge member 210 and the second hinge member 220 are coupled with each other while facing each other, the guide cam 231 is inserted into the stopper groove 232, and the pair of click protrusions 215 formed on the first hinge member 210 is inserted into the pair of click grooves 224.

Figure 15:
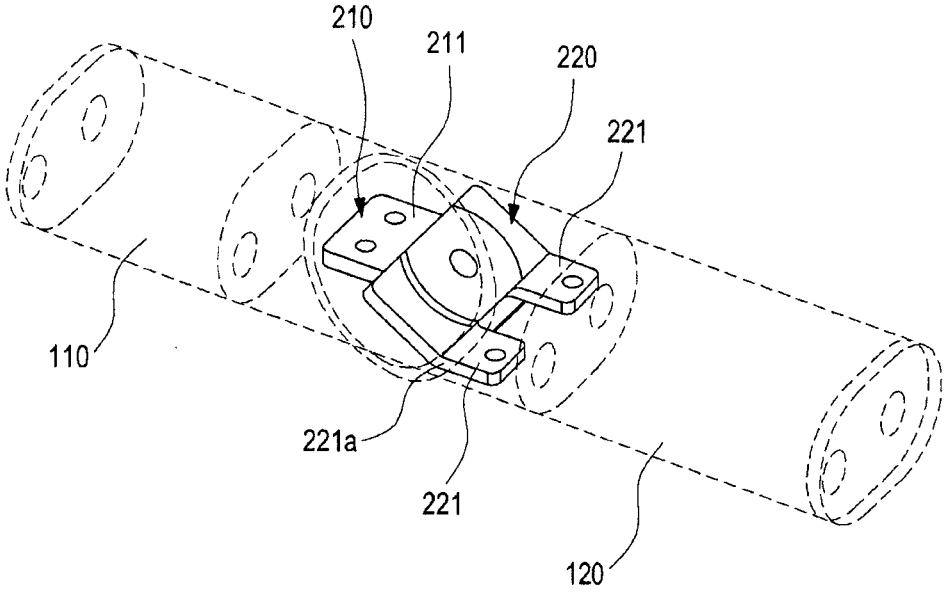
FIG. 15 is a perspective view showing a coupled state of a swivel hinge apparatus for an electronic device according to the second embodiment of the present invention.

In this state, as shown in FIGS. 14 and 15, the first engagement portion 211 of the first hinge member 210 is engaged with the first housing 110, and the second engagement portion 221 of the second hinge member 220 is engaged with the second housing 120. The first hinge member 210 and the second hinge member 220 correspond to the first inclined surface 111 and the second inclined surface 121 of the first housing 110 and the second housing 120, and the inclinedly bent first engagement portion 211 and the inclinedly bent second engagement portion 221 are engaged in the longitudinal direction of the first housing 110 and the second housing 120, thereby facilitating engagement with the first housing 110 and the second housing 120 and improving the strength of the engagement.

Figure 17:
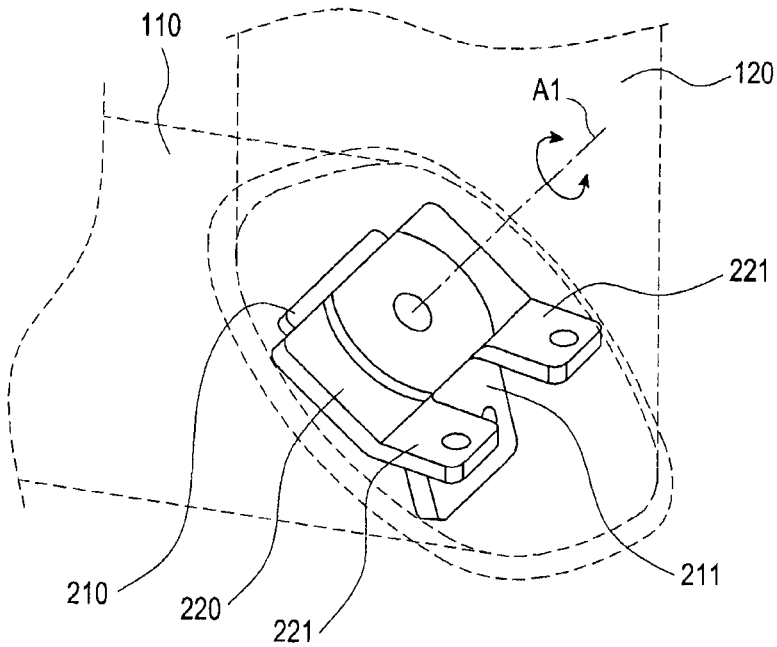
FIG. 17 is an enlarged perspective view showing a post-operation state (after-operation state) of a swivel hinge apparatus for an electronic device according to the second embodiment of the present invention.

Herein, as shown in FIGS. 16 and 17, when the second housing 120 rotates from the first housing 110 around the hinge axis A1 in a bent manner, the cap 500 coupled with the second housing 120 is removed from the second housing 120. In this state, the second hinge member 220 rotates and the stopper groove 232 of the guide stopper portion 230 also rotates.

Figure 18:
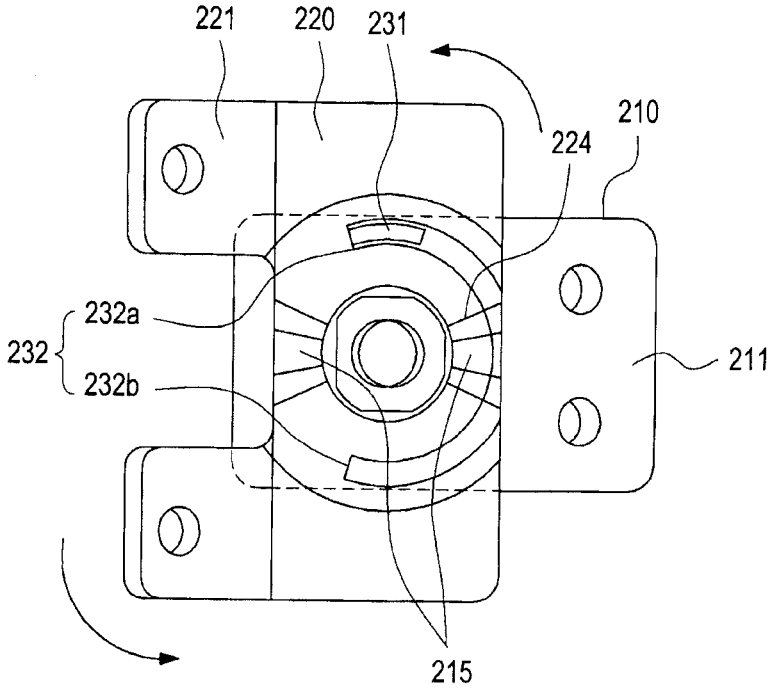
FIG. 18 is a plane view showing a pre-operation state (before-operation state) of a guide stopper portion of a swivel hinge apparatus for an electronic device according to the second embodiment of the present invention.
Figure 19:
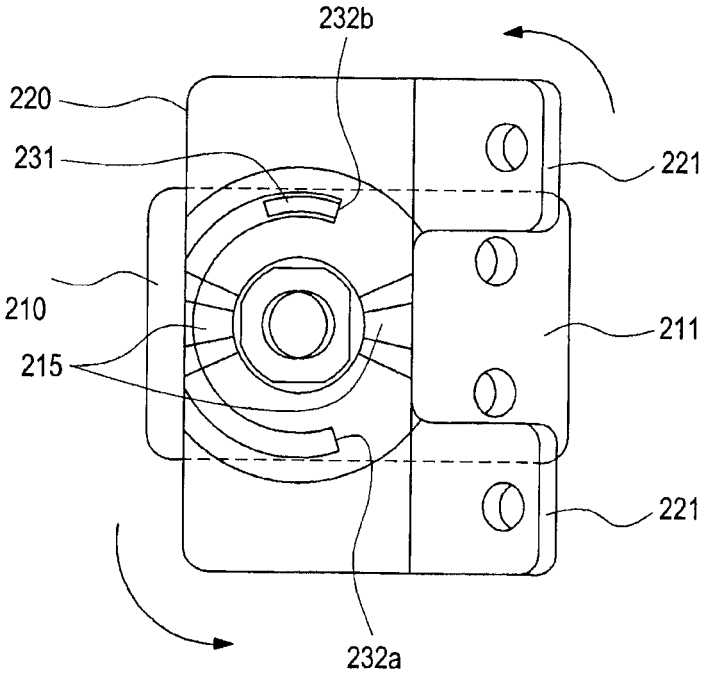
FIG. 19 is a plane view showing a post-operation state (after-operation state) of a swivel hinge apparatus for an electronic device according to the second embodiment of the present invention.

In this state, as shown in FIGS. 18 and 19, the first stopper portion 232*a* of the stopper groove 232 leaves the guide cam 231, and the stopper groove 232 rotates such that the second stopper portion 232*b* of the stopper groove 232 contacts the guide cam 231 in the rotation end position, thereby restricting rotation of the second hinge member 220.

At this time, the pair of click grooves 224 formed in the second hinge member 220 also rotate, and the pair of click protrusions 215 formed on the first hinge member 210 is inserted into the pair of click grooves 224 in the rotation end position of the second hinge member 220, thereby providing a clicking sense.

In this case, as shown in FIGS. 13, 17, and 19, the elastic member 240 provides an elastic force for allowing linear movement of the first hinge member 210 along the hinge axis A1 and an elastic force for allowing linear rotation of the pair of click protrusions 215 of the first hinge member 210 such that the pair of click protrusions 215 is engaged with or disengaged from the pair of click grooves 224. The elastic member 240 also provides an elastic force for allowing the second hinge member 220 to rotate around the hinge axis A1.

As shown in FIG. 16, the first housing 110 and the second housing 120 form an inverted "L" shape as the second housing 120 rotates 180 degrees. In this state, the speaker portion 400 provided in the first housing 110 is inserted into a user's ear and the microphone portion 300 provided in the second housing 120 is brought to close contact with a user's mouth.

Herein, when the second housing 120 rotates 180 degrees around the hinge axis A1, the BLUETOOTH technology, with BLUETOOTH being a short range wireless communications technology at the 2.4 GHz band, commercially available from the BLUETOOTH SPECIAL INTEREST GROUP, INC., is turned on and thus the headset 101 is used; when the second housing 120 rotates to the original position, the BLUETOOTH technology is turned off, with BLUETOOTH being a short range wireless communications technology at the 2.4 GHz band, commercially available from the BLUETOOTH SPECIAL INTEREST GROUP, INC., and thus the headset 101 does not operate.

As shown in FIGS. 14, 15, 18, and 19, to rotate the second housing 120 to the original position around the hinge axis A1, the second hinge member 220 also rotates around the hinge axis A1, together with the stopper groove 232 of the guide stopper portion 230. If the second hinge member 220 rotates to the rotation initial position, the second stopper portion 232*b* of the stopper groove 232 leaves the guide cam 231 and the stopper groove 232 rotates such that the second stopper portion 232*b* of the stopper groove 232 contacts the guide cam 231 in the rotation initial position, thereby restricting rotation of the second hinge member 220.

In this state, as shown in FIGS. 18 and 19, the pair of click grooves 224 formed in the second hinge member 220 also rotate again, and the pair of click protrusions 215 formed on the first hinge member 210 is inserted into the pair of click grooves 224 in the rotation initial position of the second hinge member 220, thus providing a clicking sense.

It will be obvious to those of ordinary skill in the art that the swivel hinge apparatus for an electronic device according to the present invention described above is not limited by the foregoing embodiments and drawings, and various substitutions, modifications, and changes can be made.

What is claimed is:

1. A swivel hinge apparatus for an electronic device comprising:

a first housing having a first longitudinal axis and a first inclined surface formed on an end of the first housing, with the first inclined surface oriented at a first angle to a plane perpendicular to the first longitudinal axis;

a second housing having a second longitudinal axis and a second inclined surface formed on an end of the second housing, with the second inclined surface oriented at a second angle to a plane perpendicular to the second longitudinal axis, the second housing rotating in a bent manner while facing the first inclined surface;

a first hinge member which is bent in a direction perpendicular to the first longitudinal axis, wherein the first hinge member has a first engagement portion for engaging the first housing;

a second hinge member which is inclinedly bent in a direction perpendicular to the second longitudinal axis, wherein the second hinge member has a second engagement portion coupled with the second housing, wherein the second hinge member is rotatably coupled with the first hinge member to rotate while facing the first hinge member;

a guide portion provided between the first hinge member and the second hinge member to guide rotation of the second hinge member;

an elastic member provided on a side of the first hinge member to provide an elastic force for allowing rotation and linear movement of the first hinge member and the second hinge member;

a support cover portion; and a shaft from which a cylindrical housing protrudes, the cylindrical housing being coupled with the first hinge member, the second hinge member, the elastic member, and the support cover portion by passing through them.

2. The swivel hinge apparatus of claim 1, wherein the support cover portion is disposed on the side of the first hinge member, with the support cover portion coupled with and supporting the elastic member.

3. The swivel hinge apparatus of claim 1, wherein the first hinge member comprises:

the first engagement portion which is engaged with the first housing and has bent portions such that the first hinge member is bent in the direction perpendicular to the first longitudinal direction of the first housing, wherein a first bent portion is oriented parallel to the first inclined surface and a second bent portion is oriented parallel to the second inclined surface;

at least one engagement hole formed in the first engagement portion; and a through-hole through which passes the cylindrical housing.

4. The swivel hinge apparatus of claim 1, wherein the second hinge member comprises:

the second engagement portion, which is engaged with the second housing and has bent portions such that the second hinge member is bent in the direction perpendicular to the second longitudinal direction of the second housing, wherein a first bent portion is oriented parallel to the first inclined surface and a second bent portion is oriented parallel to the second inclined surface;

at least one engagement hole formed in the second engagement portion; and a rotation hole which is rotatably coupled with the cylindrical housing while the cylindrical housing is positioned therein, permitting rotation of the cylindrical housing about an axis normal to one of the first inclined surface and the second inclined surface.

5. The swivel hinge apparatus of claim 1, wherein the guide portion comprises:

at least one engagement/disengagement hole formed in the first hinge member; and at least one hemispheric emboss portion that protrudes from the second hinge member and is engaged with or disengaged from a corresponding one of the at least one engagement/disengagement hole to provide a clicking sense in a rotation initial or end position of the second hinge member.

6. The swivel hinge apparatus of claim 1, wherein the elastic member comprises a disc spring.

7. The swivel hinge apparatus of claim 1, wherein the first hinge member includes a stopper protrusion for stopping rotation of the second hinge member when the second hinge member contacts the stopper protrusion.

8. The swivel hinge apparatus of claim 1, wherein the guide portion comprises:

at least one engagement/disengagement hole formed in the first hinge member;

at least one ball hole formed in a surface of the second hinge member; and at least one ball which are coupled with a complementary at least one ball hole by passing through the complementary at least one ball hole, which contact the at least one engagement/disengagement hole, and which are engaged with or disengaged from the at least one engagement/disengagement hole by rotation of the second hinge member to provide a clicking sense in a rotation initial or end position of the second hinge member.

9. The swivel hinge apparatus of claim 1, wherein the first housing and the second housing are oriented to form an "L" shape as the second housing rotates 180 degrees about an the axis normal to at least one of the first inclined surface and the second inclined surface.

* * * * *

UNITED STATES PATENT AND TRADEMARK OFFICE

CERTIFICATE OF CORRECTION

PATENT NO. : 8,533,916 B2
APPLICATION NO. : 13/281527
DATED : September 17, 2013
INVENTOR(S) : Sung-Ho Ahn It is certified that error appears in the above-identified patent and that said Letters Patent is hereby corrected as shown below:

In the Claims

Column 15, Claim 9, Lines 11-12 should read as follows:
--...degrees about an axis normal...--

Signed and Sealed this
Nineteenth Day of November, 2013

Teresa Stanek Rea
*Deputy Director of the United States Patent and Trademark Office*